US010259108B2

(12) United States Patent
Duncan et al.

(10) Patent No.: US 10,259,108 B2
(45) Date of Patent: Apr. 16, 2019

(54) PALLET DISMANTLING APPARATUS

(71) Applicants: Stewart Duncan, Sanford, FL (US); Richard Fongeallaz, Orlando, FL (US)

(72) Inventors: Stewart Duncan, Sanford, FL (US); Richard Fongeallaz, Orlando, FL (US)

(73) Assignees: Stewart Duncan, Sanford, FL (US); Richard Alan Fongeallaz, Orlando, FL (US)

( * ) Notice: Subject to any disclaimer, the term of this patent is extended or adjusted under 35 U.S.C. 154(b) by 0 days.

(21) Appl. No.: 14/657,037

(22) Filed: Mar. 13, 2015

(65) Prior Publication Data

US 2016/0264386 A1 Sep. 15, 2016

(51) Int. Cl.

| | |
|---|---|
| ***B66F 15/00*** | (2006.01) |
| ***B25G 1/06*** | (2006.01) |
| ***B25B 27/02*** | (2006.01) |
| ***B25B 27/04*** | (2006.01) |

(52) U.S. Cl.

CPC ..... *B25B 27/02* (2013.01); *B25B 27/04* (2013.01); *B25G 1/06* (2013.01); *B66F 15/00* (2013.01)

(58) Field of Classification Search

CPC ..... B25C 11/00; B66F 15/00; B66F 19/005

USPC ..... 254/21, 25, 27, 116, 119, 129, 130, 254/131.5; 29/267

See application file for complete search history.

(56) References Cited

U.S. PATENT DOCUMENTS

| | | | | | |
|---|---|---|---|---|---|
| 1,309,734 | A * | 7/1919 | Hemfling, Sr. | B66F 15/00 | 254/131 |
| 1,329,436 | A * | 2/1920 | Smiley | B66F 15/00 | 254/38 |
| 1,375,751 | A * | 4/1921 | Grannis | B25B 27/00 | 254/129 |
| 1,389,820 | A * | 9/1921 | Downey | E04G 23/08 | 254/131 |
| 1,821,041 | A * | 9/1931 | Turner | E01B 29/26 | 254/27 |
| 2,374,530 | A * | 4/1945 | Fiebke, Sr. | E04G 23/08 | 254/120 |
| 2,520,427 | A * | 8/1950 | Nelson | E04G 23/08 | 254/131 |
| 2,625,370 | A * | 1/1953 | Huggins | A01B 1/04 | 254/131.5 |
| 2,921,773 | A * | 1/1960 | Hoelzer | B65G 7/12 | 254/129 |
| 3,049,337 | A * | 8/1962 | Griggs | E04G 23/08 | 254/131 |
| 3,275,299 | A * | 9/1966 | Meshew | B66F 19/005 | 254/131 |
| 3,467,405 | A * | 9/1969 | Fogg | B66F 15/00 | 254/131 |

(Continued)

*Primary Examiner* — Tyrone V Hall, Jr.

(57) ABSTRACT

An apparatus is disclosed for dismantling a pallet comprising an elongated handle having a free end and an attachment end, wherein the attachment end is coupled with a crossbar having a horizontal axis extending perpendicular to the plane of the handle. The apparatus also has one or a plurality of blades extending rigidly forward in adjustable communication with the crossbar via a notched aperture in each blade for receiving the crossbar, wherein each blade further comprises a lower curved portion, and an upper portion for engaging a board of a pallet, at least one wheel rotatably coupled with said lower curved portion, and means for clamping the blades to the crossbar.

14 Claims, 9 Drawing Sheets

(56) References Cited

U.S. PATENT DOCUMENTS 4,183,503 A * 1/1980 Ward ..... B66F 15/00 254/131
4,490,088 A * 12/1984 Castle ..... B62B 5/0089 254/131
4,549,350 A * 10/1985 Patillo ..... A47G 27/0487 15/236.05
5,265,661 A * 11/1993 Tran ..... B60C 25/02 157/1.3
6,302,375 B1 * 10/2001 Heil ..... B66F 15/00 254/131
6,644,627 B1 * 11/2003 Forrester ..... B66F 15/00 254/131
6,663,083 B1 * 12/2003 Smith ..... B25C 11/00 254/131
6,676,111 B2 * 1/2004 Bigham ..... B66F 19/005 254/131
D498,129 S * 11/2004 Parker ..... D8/89
7,025,331 B2 * 4/2006 Whelan ..... B25G 1/06 254/25
7,163,041 B1 * 1/2007 Tran ..... B60C 25/02 157/1.1
7,278,626 B1 * 10/2007 Chang ..... B66F 15/00 254/25
7,682,099 B2 * 3/2010 Cole ..... B25F 1/04 192/69.91
8,215,617 B2 * 7/2012 Liou ..... B66F 15/00 254/131
8,297,596 B2 * 10/2012 Su ..... B66F 15/00 254/129
8,342,482 B2 * 1/2013 Smith ..... B66F 15/00 254/131.5
8,424,845 B2 * 4/2013 Cole ..... B25D 1/045 254/22
8,434,739 B1 * 5/2013 Connolly ..... B66F 15/00 254/130
8,511,207 B2 * 8/2013 Su ..... B25G 1/06 254/25
8,517,401 B1 * 8/2013 Horn ..... B62B 5/0089 280/47.15
8,550,437 B2 * 10/2013 Liou ..... B25F 1/00 254/115
8,707,492 B2 * 4/2014 Conibear ..... B25F 1/006 7/145
8,708,312 B2 * 4/2014 Stawarski ..... B25G 1/06 192/69
9,315,368 B2 * 4/2016 Arivett ..... B66F 15/00
2001/0025950 A1 * 10/2001 Gjerde ..... B66F 15/00 254/25
2005/0211961 A1 * 9/2005 Edwards ..... B66F 15/00 254/25
2008/0251773 A1 * 10/2008 Smeeton ..... B66F 3/005 254/113
2010/0140575 A1 * 6/2010 Liou ..... B66F 15/00 254/131.5
2010/0176356 A1 * 7/2010 Su ..... B66F 15/00 254/129
2010/0207081 A1 * 8/2010 Liou ..... B25D 1/00 254/129
2012/0102699 A1 * 5/2012 Bruce ..... B25B 27/02 29/275
2012/0223279 A1 * 9/2012 Liou ..... B25F 1/00 254/130
2013/0175486 A1 * 7/2013 Stawarski ..... B25G 1/06 254/129
2013/0327998 A1 * 12/2013 Su ..... B25G 1/06 254/129
2014/0117295 A1 * 5/2014 Shaw ..... E04H 17/265 254/30
2014/0145127 A1 * 5/2014 Su ..... B25G 1/04 254/129
2014/0182107 A1 * 7/2014 Nestor ..... B66F 15/00 29/426.5
2016/0023873 A1 * 1/2016 Kasan ..... E04G 23/08 254/131.5

* cited by examiner

PALLET DISMANTLING APPARATUS

FIELD OF THE INVENTION

The invention relates to new and useful improvements in tools for dismantling pallets.

COPYRIGHT

Copyright—A portion of the disclosure of this document contains material that is subject to copyright protection. The copyright owner has no objection to the facsimile reproduction by anyone of the patent document or the patent disclosure, as it appears in publically available Patent and Trademark Office patent files or records, but otherwise reserves all copyright rights whatsoever. The following notice applies to the description which may be described below and in the drawings that form a part of this document: Copyright Stewart Duncan and Richard Fongeallaz, All Rights Reserved.

BACKGROUND

Pallets are composed simply of a rough grid of boards capable of being lifted using a forklift or like machinery and are used for transporting a number of goods. There are usually composed of three longitudinal boards overlaid with a series of horizontally lying flat hoards which serve as the surface for supporting the transported goods. Wooden pallets are the most common type of pallet and are constructed using wooden boards. These boards may be recycled and used for other purposes if the pallet can be dismantled without damaging the board. Current prying devices may dismantle pallets, however they tend to splinter the boards and are difficult to use, particularly manually.

SUMMARY

Disclosed is an apparatus for dismantling pallets. The preferred structure of the apparatus broadly comprises a handle, which is a rigid elongated handle, having a free end for engaging with an operator, and an attachment end for coupling with a crossbar. In removable and adjustable communication with the crossbar are a plurality of blades (preferably two, parallel blades) extending rigidly forward from the crossbar so as to form a prying claw. The position of the blades is adjustable along the horizontal axis of the crossbar. When in use, the blades are adjusted so as to flank the longitudinal board of the pallet and the blades are placed underneath the board sought to be pried.

The blades are preferably steel and have an upper portion for engaging a horizontal board of a pallet and a lower curved portion. Each blade has a notched aperture for receiving the crossbar. The notched aperture comprises preferably eight grooves having an angular configuration with 90° angles capable of receiving the crossbar, which may have a preferably square or generally quadrangular cross section.

In addition, the apparatus comprises a plurality of wheels located just behind the peak of the lower curved portion of the blade such that the axis formed between at least two wheels forms a fulcrum point about which the apparatus pivots during use. These wheels may be located on an inward facing side of a blade or the outward facing side of as blade, or both. In embodiments where the wheels are positioned on the inward facing side of the blades, the wheels serve to reduce the amount of downward force necessary to pry a board lose from the pallet. The wheels also serve as a rolling axis for transporting a pallet or board resting on the blades. These features are further discussed in the Detailed Description, as are the variations contemplated and described in the therein, the content of which is incorporated in this Summary.

DETAILED DESCRIPTION

Figure 3:
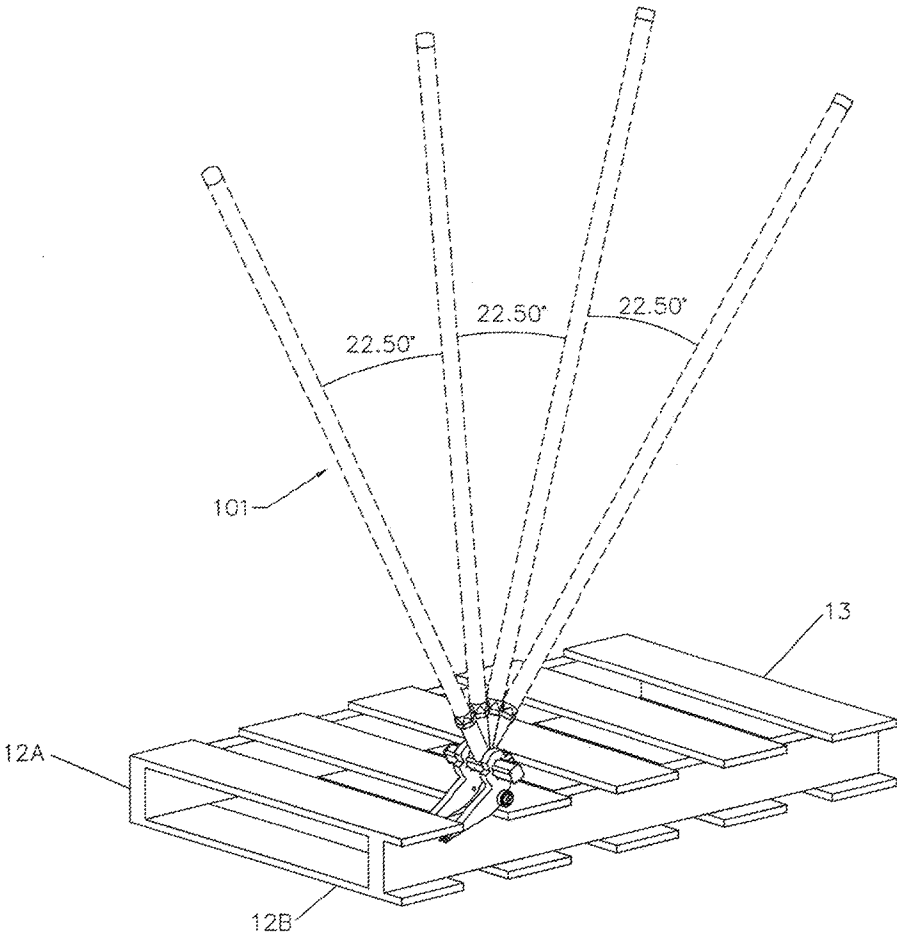
FIG. 3 is an environmental view of the apparatus in accordance with an embodiment.

With reference to the drawings, the apparatus 101 is concerned with the dismantling of standard wooden pallets without splintering and breaking their boards. Pallets generally have two or three longitudinal boards, e.g., 12, 12*a,b*. On the top and bottom of these longitudinal boards are attached several perpendicular horizontal boards, e.g., 13. A longitudinal board 12 and a horizontal hoard 13 are usually attached to one another with nails. The pallet shown in FIG. 3 is given to provide context for the use of the apparatus, although the apparatus may be used with pallets having other board arrangements.

Figure 1:
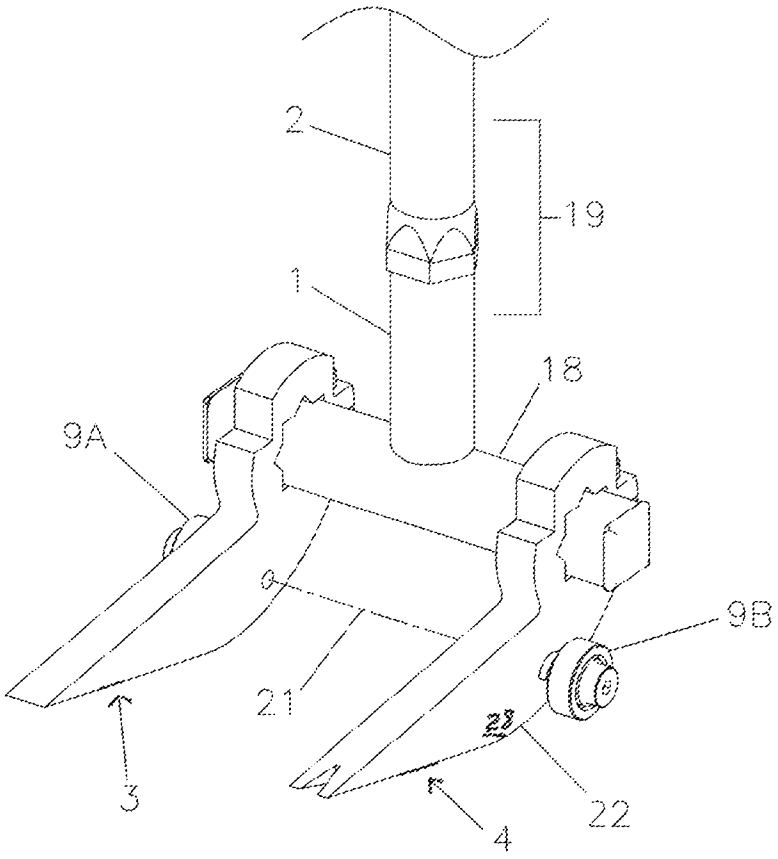
FIG. 1 is a close-up view of the apparatus in accordance with an embodiment.

The preferred structure of the apparatus as shown in FIG. 1 comprises a handle 19, which is a rigid elongated handle, having a free end 2 for engaging with an operator, and an attachment end 1 for coupling with a crossbar 18 for receiving a plurality of blades 3, 4. The horizontal axis of the crossbar is preferably situated perpendicular to the longitudinal plane of the handle 19.

In the preferred embodiment, the apparatus receives two blades, blades 3 and 4. The blades have a curved portion along the lower edge (serving as a general point of pivot) (hereinafter referred to as the "lower curved portion") and an upper portion along the opposite end for engaging with a horizontal board of a pallet. The blades are preferably constructed using a sturdy, solid material such as steel, iron, or other metal or a mixture of metals having a similar rigidity as steel or iron.

Figure 2:
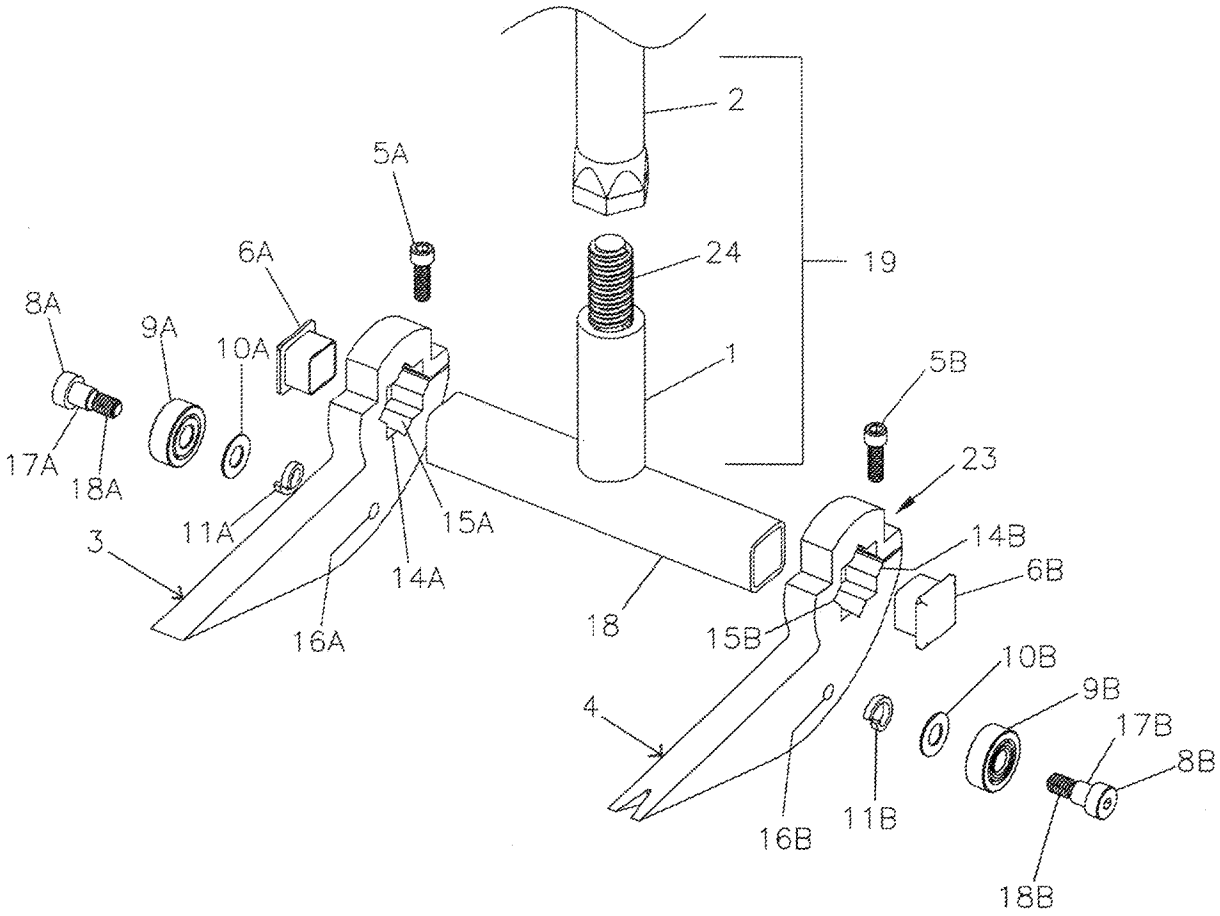
FIG. 2 is an exploded view of the apparatus in accordance with an embodiment.

FIG. 2 shows the exploded view of the apparatus for demonstrating its preferred configuration. Each blade 3, 4, has a corresponding notched aperture 15*a,b* for receiving the crossbar 18. These notched apertures comprise preferably equally spaced grooves 14*a,b*, having an interior angle of 90°. This right angle configuration of the grooves 14*a,b* permits the blades to removably slide over crossbar 18, the crossbar having a preferably quadrangular cross section. The advantage of the ability of the blades to slide along the crossbar 18 is that the blades may be positioned on any spaced relation along, the crossbar 18 (for spacing the blades closer together or further apart), depending on the width of the pallet's longitudinal board. This allows the apparatus to more advantageously accommodate pallets with varying sized longitudinal boards.

Figure 5:
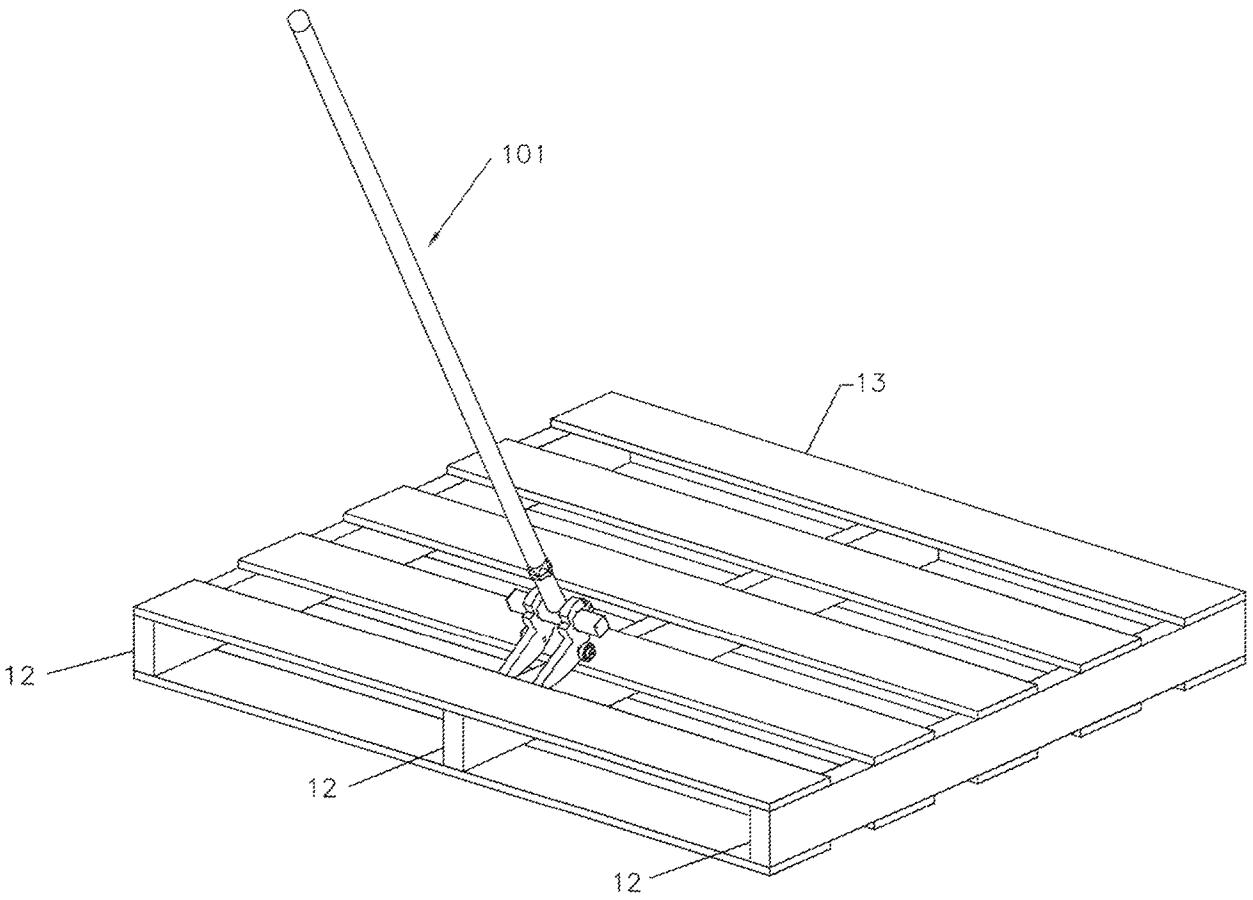
FIG. 5 is an alternative environmental view of the apparatus engaging with a pallet, in accordance with an embodiment.

As shown for example in the environmental view of FIG. 5, the preferred positioning of the blades is such that the blades are spaced so as to flank the longitudinal board 12. For example, if a longitudinal board is 2 inches thick, the blades may be adjusted so as to be 2 inches apart. If a longitudinal board is 2.5 inches wide, the blades would be repositioned so as to be 2.5 inches apart, and so on. The adjustability of the blades in this manner provides for a prying tool that reduces damage to the horizontal boards of pallets. This is because boards pried where the blades are spaced wider than the width of the longitudinal board may result in splintering, of the horizontal hoard when pried.

Continuing with FIG. 2, the crossbar 18 in the embodiment shown has a cross-section of a square. The notched apertures 15*a,b* have 8 total grooves 14*a,b*. This is the preferred configuration, as it permits the blades 3,4 to be attached to the crossbar 18 such that the angle between the upper portion 20 and the handle 19 may be adjusted in roughly 22.5° increments (as shown in FIG. 3). The number of grooves 14*a,b* and the cross-sectional shape of the crossbar 18 may be varied correspondingly such that the blades 3, 4 may be adjusted in finer increments, however, the configuration shown is preferred because as 90 degree groove will grip the crossbar more securely than would obtuse angles. It should also be noted that although it may be possible to have many more than eight teeth, each having an angle of 90 degrees, the depth of the teeth would have to be smaller with each additional tooth added. Eight teeth are shown because it permits a sufficient tooth depth for securely engaging will the quadrangular cross bar. If more an more teeth were added, the depth of the teeth would have to be reduced in order to maintain the 90 degree angle. The number of teeth may vary, but the tooth depth is preferably between ½ to ¼ of the length of the crossbar diameter. Anything out of this range reduces the amount of force each tooth can withstand resulting in the potential for the crossbar to strip the teeth and cause the apparatus to slip.

Further detailed structures of the apparatus shall now be described. The apparatus has a plurality of blades, each having corresponding structures for coupling each blade with the crossbar. At times in this disclosure it is convenient to describe the structures on one blade for coupling the blade to the crossbar with the understanding the additional blade or blades will have corresponding structures for coupling it to the crossbar. The exception to this is that blade tips may have differing shapes, as shown in FIG. 1 (Blade 4 has a triangular notch at its tip, whereas blade 3 is a solid blade with a straight tip).

Blades 3,4 are secured on the crossbar by clamping them to the crossbar. Closure trim 6, having a shape that conforms to the crossbar 18 may be added, but is not required. Clamping bolt 5*a,b* secures the blade to the crossbar at an opening 23 on the rear side of the blade 3,4. The clamping bolt 5*a,b* is used as part of means for clamping the to the crossbar using frictional clamping which n described next. This bolt may be loosened so that a given blade 3, 4 may be oriented in any position along the horizontal axis of the crossbar, and then tightened when the blade is placed at the desired location.

Figure 9:
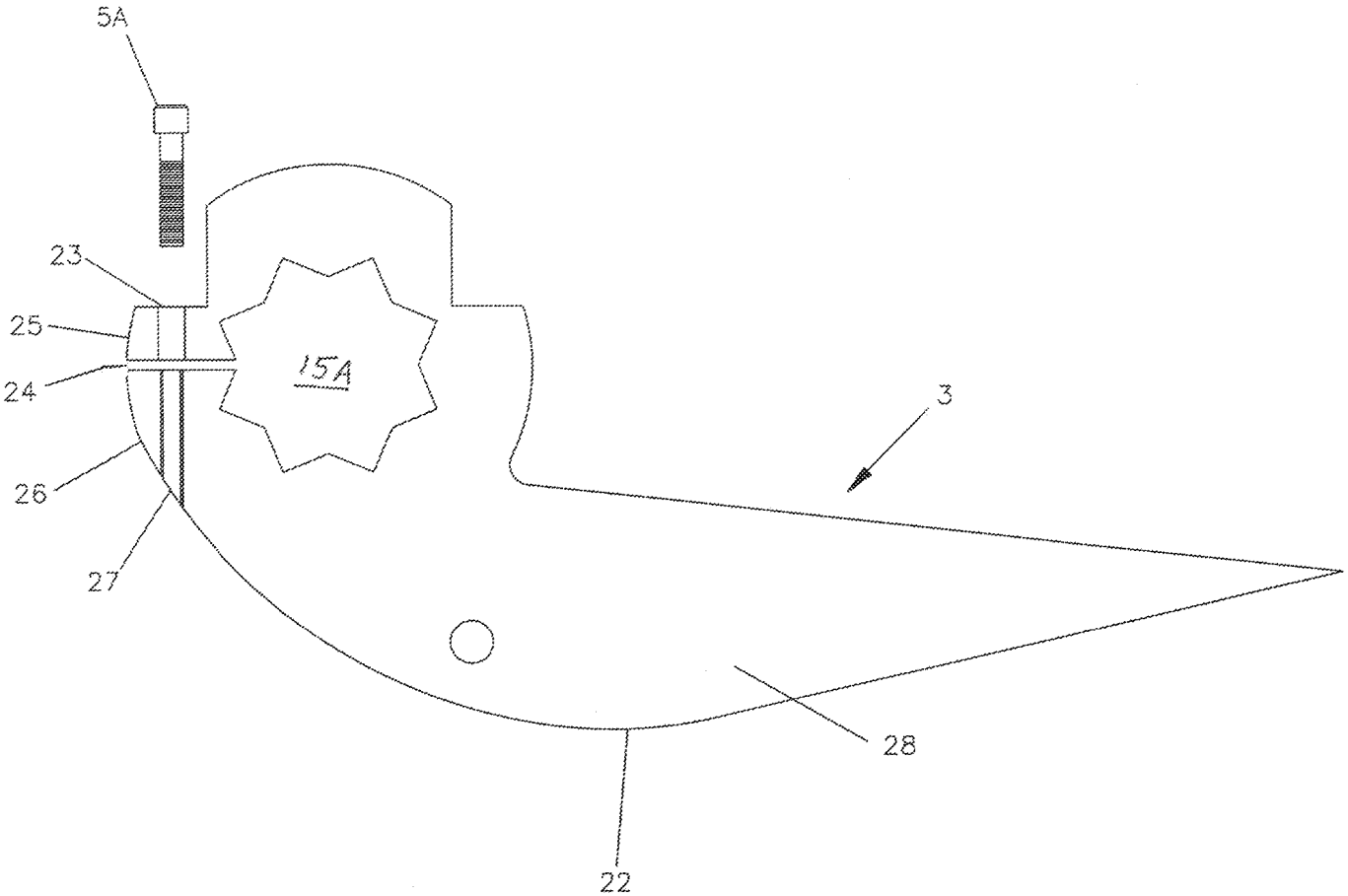
FIG. 9 is a close-up view of a blade of the device

Frictional clamping is achieved broadly by tightening the notched aperture 15A around the crossbar slightly. For ease of explanation, this Detailed Description describes exemplar means for clamping one blade (blade 3) as shown on FIG. 2 on the crossbar 18. However, it is understood that all blades pictured have corresponding structures for clamping the blade onto the crossbar. FIG. 9 shows a closeup of blade 3 to more closely show its structure. Referring to FIG. 9, to fix the blade 3 in a desired position along the crossbar 18, the blade is constructed so as to have an upper clamping portion 25 and lower clamping portion 26 in spaced relation to each other such that a gap 24 exists between them. Gap 24 extends to notched aperture 15*a*. The two clamping portions (25 and 26) may be brought toward each other using a suitable means. For instance, clamping bolt 5*a* may be used to tighten the upper clamping portion 25 of the blade toward a lower clamping portion 26 of the blade to generate the clamping three within the notched aperture 15*a*. When the clamping bolt 5*a* is screwed through opening 23, it is screwed into a threaded recess 27 within the lower clamping portion 26. The threaded recess 27 may be fabricated directly within the lower portion itself, or it may be a nut recessed within the lower clamping portion 26. When the screw is tightened, gap 27 narrows such that the blade 3 is more tightly engaged to the crossbar 18. This increases the friction required to slide the blade 3 along the crossbar's horizontal axis, and by doing so appropriately fixes the angular position of the blade 3 at the desired position on the crossbar 18.

Figure 6:
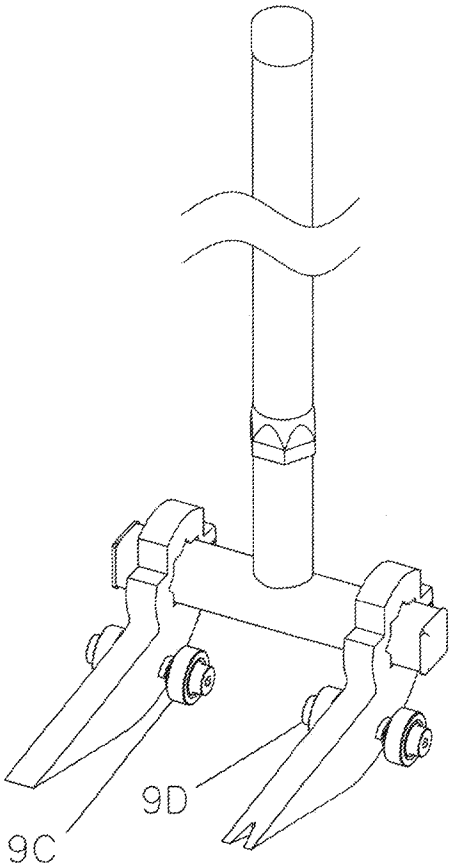
FIG. 6 is an assembled view of the apparatus in accordance with an embodiment.
Figure 7:
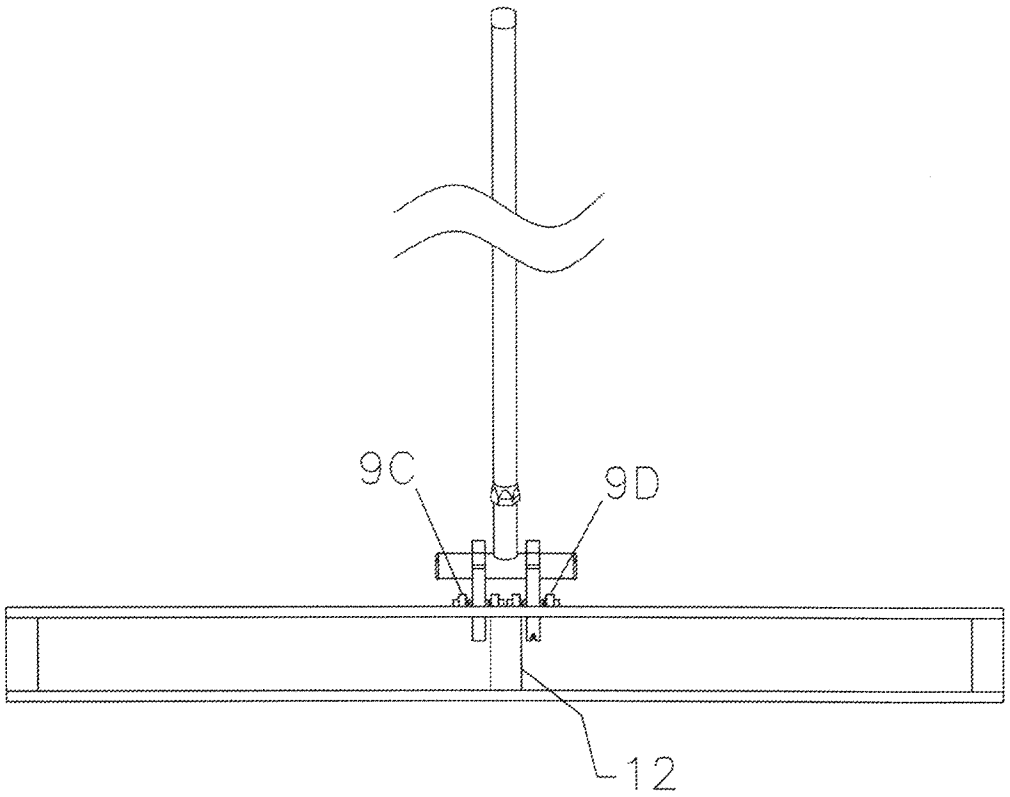
FIG. 7 shows an environmental view of the apparatus as viewed from the front of the apparatus, engaging with a pallet, in accordance with an embodiment.
Figure 8:
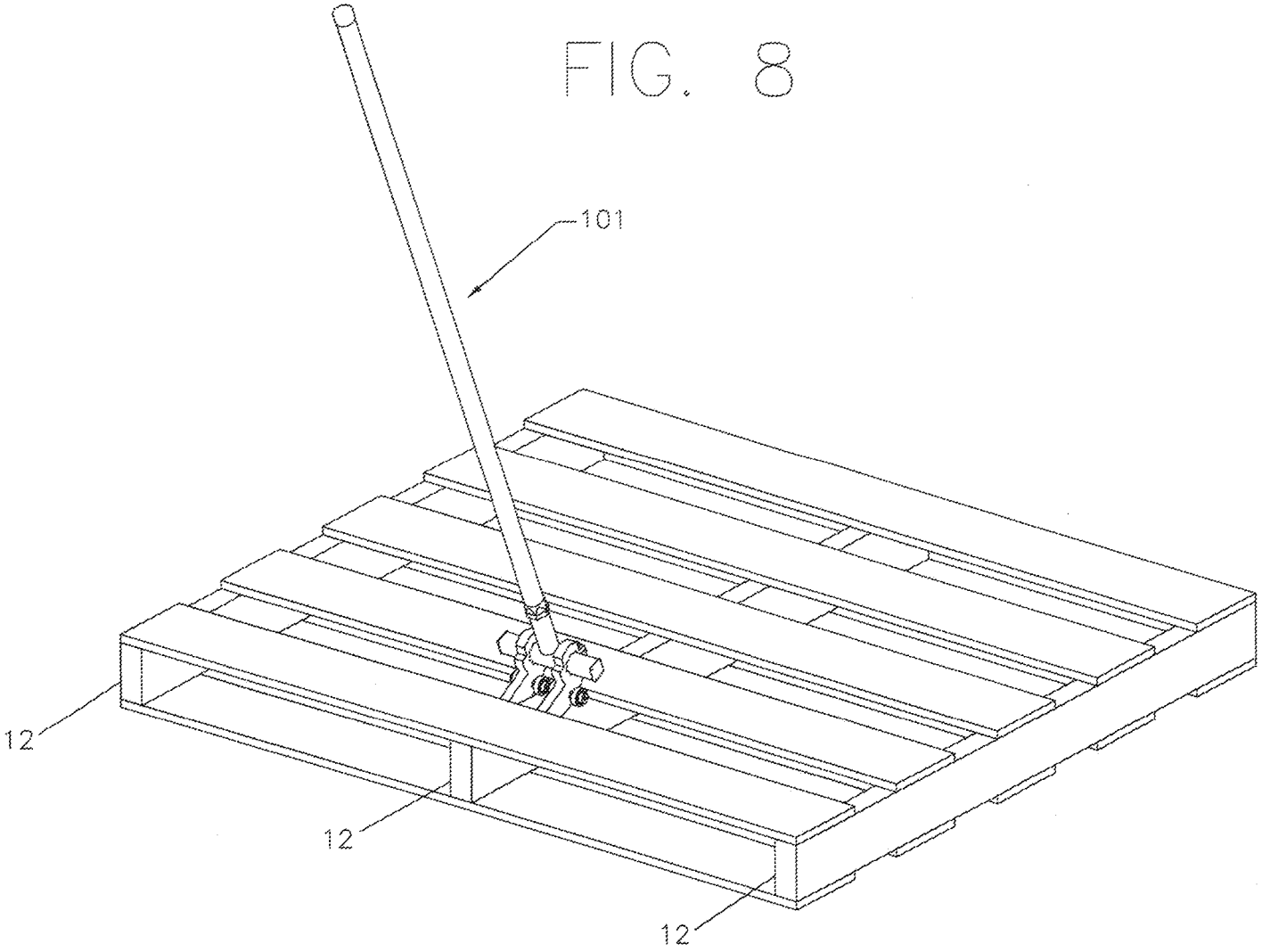
FIG. 8 an alternative environmental view of the apparatus engaging with a pallet, in accordance with an embodiment.

The apparatus also has wheels. These wheels may be positioned on the outward facing side of the blades as shown in FIGS. 1-5, or may be located on both the outward facing side of the blades and the inward facing sides of the blades as shown in FIGS. 6-8. Although not shown, the apparatus may also have wheels on only the inward facing side of its blades. On the lower curved portion 28 of the blade is situated at least one wheel, e.g., 9*b*. The wheels on the blades serve multiple purposes, depending on the location of the wheels. For example, wheels located on the inward facing side of the blades as well as wheels on the outward facing side of the blades allow an operator to roll a pallet along the ground. The wheels located on the outward facing sides of the blades serve primarily as a rolling surface for transport of the pallet as a whole. In the embodiment of FIGS. 6-8, the wheels on the inward facing surface of the blades may engage with a longitudinal hoard of a pallet, as shown in the environmental views of FIGS. 7 and 8. When the apparatus of this embodiment is in use to pry off a horizontal hoard of a pallet, the wheels on the inward facing side of the blades roll along the top of the longitudinal board. The advantage of this feature is that it reduces the downward force necessary to pry under the horizontal board.

Continuing with FIG. 2, wheels 9*a,b*, may be any known wheel in the art with a diameter preferably smaller than the length of the blade. Each wheel is coupled to its blade preferably via a screw 8*a,b* with axle 17*a,b* at one end and threaded portion 18*b* at the other end. Each blade 3,4 has a threaded bore 16*a,b* for receiving the threaded portion 18*b* of the screw. The wheel itself surrounds axle 17*a, b*, such that the wheel may secured to the blade in a manner that permits free rotation of the wheel about the axle. On the side of the wheel 9*a,b* nearest the blade 3,4, a washer 10 and a lock washer 11 space the wheel so that it is not directly touching the blade. As mentioned previously, the preferred location for the wheel is just behind the peak 22 of the lower curved portion 28 of each blade 3,4. Although one wheel per blade is shown, embodiments having a wheel on either side of the blade are contemplated as are other methods known in the art for securing a wheel rotatably to as surface. There may also be a plurality of wheels on either side of the blade.

Because the apparatus has at least two wheels (at least one on each blade) an axis 21 exists between the at least two wheels defining a fulcrum point which is the peak 22 of the lower curved portion 28 of the blade 3 about which the apparatus pivots when a rearward and downward force is applied on the handle 19. To that end, the apparatus functions so as to receive a downward force on handle 19, causing the blades 3, 4 to engage with a horizontal board, e.g., 13, to loosen the horizontal board from the pallet. To use the apparatus, an operator positions the blades so that they are spaced to closely fit around the longitudinal hoard of a pallet. Then, the operator places the blades tips under the horizontal board (as depicted in FIG. 3). Next, the operator applies a downward and rearward force on the handle 19. This causes the apparatus to pivot along the fulcrum point allowing the blades to pry off the horizontal board.

Advantages to the apparatus include the reduction in splintering and breaking of pallet boards that can occur using standard prying devices to dismantle pallets. This is because the construction of the lower curved portion 28 and positioning of the blades along the crossbar together allow the apparatus to smoothly remove the pallet boards. This is further aided by the addition of wheels behind the peak 22 of the lower curved portion 28. In use, the apparatus disclosed is so gentle on pallets that virtually all boards removed from a pallet using the apparatus may be reused.

Figure 4:
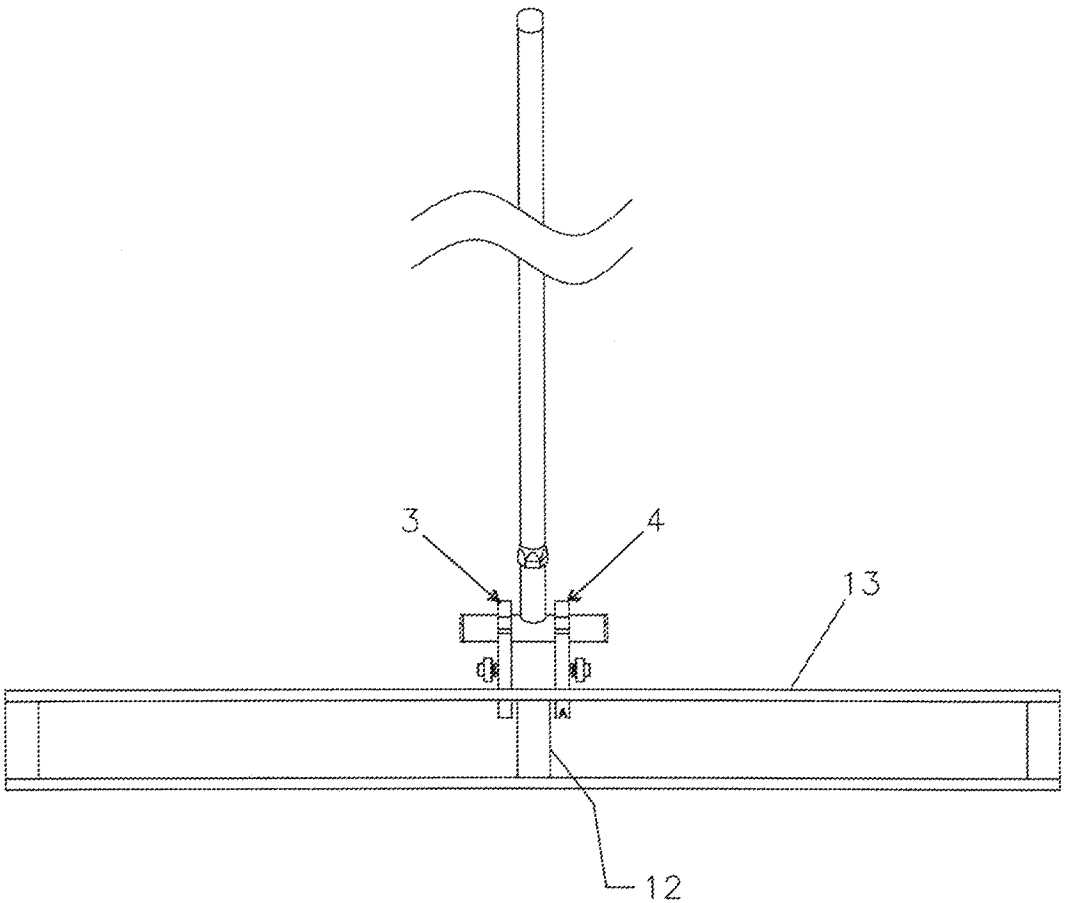
FIG. 4 shows an environmental view of the apparatus as viewed from the front of the apparatus, engaging with a pallet, in accordance with an embodiment.

FIGS. 3, 4, 5, and 8 show embodiments of the apparatus in an environmental view to illustrate its manner of use. These Figures are provided to further illustrate how the apparatus is used and how the blades of the apparatus may be adjusted so as to flank a longitudinal board. FIG. 4 is a view from in front of the apparatus, wherein the blades are positioned closely to the pallet board sought to be pried. Here, the engagement of blades 3, 4 with the pallet is shown. The blades are shown adjusted so as to flank a longitudinal board 12. Blades 3, 4 slide underneath horizontal board 13 at the point where horizontal board 13 attaches to longitudinal board 12. FIG. 5 is an alternate perspective view of this engagement and the manner of use of the apparatus is apparent from the Figures.

The foregoing has been a detailed description of two preferred embodiments of the apparatus, however, various modifications and equivalents can be made without departing from the scope and spirit of the invention. For example, the apparatus may be fashioned using various ornamentation, out of materials of varying metal blends for the blades. The handle may be made of metal, wood, or other similar rigid material. Components such as the screws, bolts, and etc., may be made from various metals known in the art. The closure trim 6*a,b* are preferably plastic, but may also be metal or other similar material. The apparatus may be used at various locales along any longitudinal board. Some connections between the various boards may be stiffer than others and may require more or less prying force. For example, a nail may be embedded in a denser location of a board in one location than in another, making it harder to pry that portion of the horizontal board loose from its longitudinal board. Or, a nail may be positioned in such a way as it would give way more readily than in other locations. The apparatus may be used for other operations and is not limited to use with pallets. Also, the operator may be human or a mechanical/electronic operator. Therefore, this description is mean to be taken by way of example and not to limit the scope of the invention.

What is claimed is:

1. An apparatus for dismantling a pallet comprising an elongated handle having a free end and an attachment end, wherein the attachment end is coupled with a crossbar having a longitudinal axis extending perpendicular to a plane of the handle;

a plurality of blades extending rigidly forward in adjustable communication with the crossbar via a notched aperture in each blade for receiving the crossbar, wherein at least two of the plurality of blades are adapted to flank a longitudinal board of the pallet and each blade further comprises:

a lower curved portion adapted to receive a wheel rotatably coupled with said lower curved portion, the wheel being configured to rotate about a rotational axis such that the rotational axis defines a fulcrum point about which the apparatus is pivotable for dismantling a pallet, an upper portion for engaging a horizontal board of a pallet; and means for clamping the blades to the crossbar; and wherein the wheel is located a distance away from the crossbar such that the rotational axis provided by the wheel is located a distance away from the longitudinal axis of the crossbar.

2. The apparatus as in claim 1, wherein the crossbar has a quadrangular cross section.

3. The apparatus as in claim 2, wherein the notched aperture comprises teeth spaced such that the handle of the apparatus may be adjusted in increments of 22.5° relative to the upper portion of each blade.

4. The apparatus as in claim 2, wherein the handle is removable and adjustable in height.

5. The apparatus as in claim 1, wherein the crossbar is tubular.

6. The apparatus as in claim 1, wherein the wheel is rotatably coupled on an inward facing side of each blade on the location corresponding to the lower curved portion of the blade.

7. The apparatus as in claim 6, wherein the wheel is rotatably coupled on an outward facing side of each blade on the location corresponding to the lower curved portion of the blade.

8. The apparatus as in claim 7, wherein the notched aperture comprises teeth spaced such that the handle of the apparatus may be adjusted in increments of 22.5° relative to the upper portion of each blade.

9. The apparatus as in claim 6, wherein the notched aperture comprises teeth spaced such that the upper portion of each blade of the apparatus may be adjusted in increments of 22.5° relative to the upper portion of each blade.

10. An apparatus for dismantling a pallet comprising an elongated handle having a free end and an attachment end, wherein the attachment end is coupled with a crossbar having a longitudinal axis extending perpendicular to a plane of the handle;

a plurality of blades extending rigidly forward in adjustable communication with the crossbar via a notched aperture in each blade for receiving the crossbar, wherein the blades are horizontally adjustable along the crossbar, the notched aperture having teeth with a depth corresponding to ½ to ¼ of a length of the crossbar diameter, wherein at least two blades are adapted to flank a longitudinal board of the pallet and each blade further comprises:

a lower curved portion having a fulcrum, the fulcrum being defined by a rotation axis of at least one wheel rotatably coupled with said lower curved portion, an upper portion for engaging a horizontal board of the pallet; and means for clamping the blades to the crossbar;

wherein the notched aperture includes teeth spaced such that the handle of the apparatus may be adjusted in increments relative to the upper portion of each blade; and wherein the wheel is located a distance away from the crossbar such that the rotational axis provided by the wheel is located a distance away from the longitudinal axis of the crossbar.

11. The apparatus as in claim 10, wherein the crossbar has a quadrangular cross section.

12. The apparatus as in claim 10, wherein the crossbar is tubular.

13. The apparatus as in claim 10, wherein the wheel is rotatably coupled to an outward facing side of its corresponding blade on a location corresponding to the lower curved portion of the blade.

14. The apparatus as in claim 10, wherein the teeth are spaced such that the handle of the apparatus may be adjusted in increments of 22.5° relative to the upper portion of each blade.

* * * * *